United States Patent [19]

Harris

[11] 4,118,385

[45] Oct. 3, 1978

[54] DISAZO COMPOUNDS

[75] Inventor: Howard A. Harris, New York, N.Y.

[73] Assignee: Shell Oil Company, Houston, Tex.

[21] Appl. No.: 768,123

[22] Filed: Feb. 14, 1977

Related U.S. Application Data

[62] Division of Ser. No. 663,426, Mar. 3, 1976, Pat. No. 4,022,700.

[51] Int. Cl.[2] ..... C07C 107/04

[52] U.S. Cl. ..... 260/175; 260/174; 260/177; 260/180; 260/181

[58] Field of Search ..... 260/174, 175, 177, 181, 260/184, 185, 187

[56] References Cited

U.S. PATENT DOCUMENTS 3,269,951 8/1966 Traise ..... 260/175 X

FOREIGN PATENT DOCUMENTS 1,087,175 10/1967 United Kingdom ..... 260/187

*Primary Examiner*—Charles F. Warren

[57] ABSTRACT

Azourethane and urea compounds corresponding to the formula

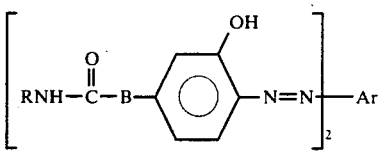

wherein R is an aliphatic hydrocarbyl radical, B is oxygen or -NH- and Ar is an arylene radical, are highly efficacious grease thickening agents.

7 Claims, No Drawings

DISAZO COMPOUNDS

This is a division of application Ser. No. 663,426, filed Mar. 3, 1976, now U.S. Pat. No. 4,022,700.

This invention relates to a novel class of azourethane and urea derivatives which are useful as organic gellants for grease formulations. More particularly, this invention is directed to certain arylazoarylurethane and arylazoarylurea compounds prepared by reacting an azophenol or azoamine with an isocyanate, which are excellent thickening agents for greases employed in high temperature applications.

In modern practice, it has become increasingly important that grease compositions be able to provide adequate lubrication at high temperature, e.g., temperatures of 350° F. to 450° F. or higher. In this regard, a variety of thickening agents have been proposed for use in such high temperature applications including soap base thickeners, inorganic clay thickeners and organic thickening agents. Of these classes of thickening agents, the organic thickeners, specifically those containing urea or ureido functional groups, have been considered quite attractice because of this ashless nature and high temperature thickening properties. Examples of such organic thickening agents include polyureas and ureido compounds as well as dibenzimidazole-diureas and related arylcarbamyl thickeners. These organic thickeners are generally prepared by reacting one or more mono, di- or polyamines with one or more mono-, di- or polyisocyanates, with the synthesis scheme in the case of the arylcarbamyl compounds involving the reaction of an aromatic amine with the reaction product of an aromatic diisocyanate and p-aminobenzoic acid.

While organic thickening agents of the aforementioned types produce greases having desirably high dropping points, this is but one measure of a grease's ability to perform satisfactorily at high temperatures. Other important properties include thermal and mechanical stability, high temperture bearing performance, oxidation and corrosion resitance, etc. While additives are normally incorporated into grease compositions to improve one or more of these properties, the thickening agent itself can significantly affect, either favorably or adversely, the properties of the finished grease product. Thus, in spite of the numerous organic thickening agents known in the art, there is a continuing need for the development of thickening agents which will not only produce greases having high dropping points, but which will additionally augment other important properties of the finished product. The present invention provides such a class of thickening agents.

DESCRIPTION OF THE PRIOR ART

Organic grease thickening agents containing azo functional groups have been described previously. U.S. Pat. No. 2,880,177 discloses lubricating greases thickened with high-melting diazo compounds of a class of benzidine derivatives obtained by coupling diazotized benzidine and substituted benzidines with arylaceto-acetarylamides and pyrazolones. In addition, U.S. Pat. No. 3,269,951 describes high temperature greases thickened with the reaction product of an aromatic isocyanate and a phenyl azoaniline compound. Finally, in a related art area, U.S. Pat. No. 3,378,491 ascribes antioxidant properties to a class of arylazoarylamine and arylazophenolic compounds, when said compounds are employed as additives in lubricant compositions.

SUMMARY OF THE INVENTION

It has now been found that grease compositions having excellent high temperature lubricating properties can be produced by incorporating into the lubricating oil base vehicle, an arylazoarylurethane compound or an arylazoarylurea compound in an amount sufficient to thicken the base vehicle to grease consistency.

The organic thickeners of the invention are novel arylazo compounds of the general structural formula:

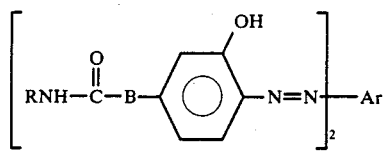

wherein R is an aliphatic hydrocarbyl radical of 16 to 22 carbon atoms, B is —NH— or oxygen and Ar is an arylene radical, optionally ring substituted with an aliphatic hydrocarbyl radical.

In addition to being very efficacious grease thickening agents in high temperature applications, the novel arylazo thickeners of the invention are quite unusual in that greases with good physical properties can be produced by mixing the dry powdered thickener in oil followed by shearing, warming and reshearing. In constrast, most of the prior art organic thickener systems produce high quality greases only when the final step in their synthesis is carried out "in situ" in the base carrier oil to produce a highly dispersed thickener phase. Thus, the thickeners of the instant invention possess an additional advantage in that they can be prepared, distributed and formulated without having to handle additional volumes of carrier oil prior to making up the final lubricant compositions.

Accordingly, the instant invention comprises the novel class of arylazo compounds described above and grease compositions thickened therewith.

DESCRIPTION OF THE PREFERRED EMBODIMENTS

As indicated above, the organic grease thickening agents of the invention are novel arylazo compounds of the formula

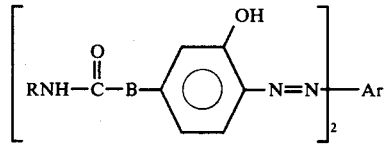

wherein R is an aliphatic hydrocarbyl radical of 16 to 22 carbon atoms, B is —NH— or oxygen and Ar is an arylene radical or an arylene radical ring substituted with an aliphatic hydrocarbyl radical. By aliphatic hydrocarbyl radical is meant monovalent organic radicals made up of carbon and hydrogen. This substitutent definition includes straight- or branch-chain, saturated or unsaturated aliphatic radicals. For the R group in the formula given above, the aliphatic hydrocarbyl substituent is preferably a straight- or branched-chain saturated aliphatic radical; most preferably, a straight-chain alkyl of 18 to 21 carbon atoms. Similarly, when Ar in the above formula is an arylene radical ring substituted with an aliphatic hydrocarbyl radical, the aliphatic substituent is preferably a straight- or branched-chain saturated aliphatic radical of 1 to 4 carbon atoms; most preferably a straight-chain alkyl of 1 to 2 carbon atoms. The arylene radical itself (designated as Ar in the above formula) may be a phenylene, naphthylene or diphenylene moiety which, in turn, may be unsubstituted or substituted as described above. Preferably, the arylene radical is a diphenylene radical either unsubstituted or substituted on each aromatic ring with a straight-chain alkyl radical of 1 to 2 carbon atoms.

The above-defined structural formula for compounds of the invention encompasses both ureas (compounds wherein B is —NH—) and urethanes (compounds wherein B is oxygen). Of these two subclases of compounds, the urethanes are preferred since they are both easy to prepare and extremely effective as grease thickening agents. In this same regard, most preferred is the azourethane compound subclass corresponding to the formula

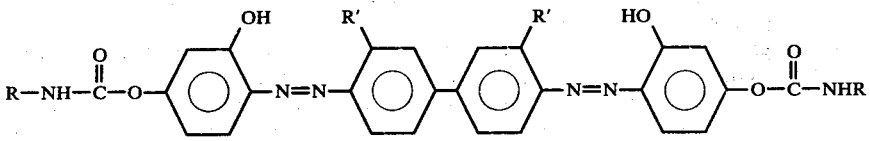

wherein R is as defined above and R' is hydrogen or straight-chain alkyl of 1 to 4 carbon atoms, preferably methyl or ethyl. Exemplary species of this preferred subclass include:

4,4'-bis(4-octadecylcarbamoyloxy-2-hydroxyphenylazo)-3,3'-dimentylbiphenyl
4,4'-bis(4-eicosylcarbamoyloxy-2-hydroxyphenylazo)-biphenyl
4,4'-bis(4-eicosylcarbamoxy-2-hydroxyphenylazo)-3,3'-dimethylbiphenyl
4,4'-bis(4-octadecylcarbamoyloxy-2-hydroxyphenylazo)-biphenyl
4,4'-bis(4-octadecylcarbamoyloxy-2-hydroxyphenylazo)-3,3'-diethylbiphenyl The arylazo grease thickening agents of the invention are conveniently prepared via a reaction scheme which involves tetrazotization or an aromatic diamine to form a tetrazonium salt followed by coupling of the tetrazonium salt with the appropriate difunctional (hydroxy or hydroxy and amine) aromatic compound to yield an arylazophenol or arylazoarylamine intermediate which is subsequently reacted with an isocyanate to yield the desired final product. The initial two synthesis steps of this reaction scheme, i.e., tetrazotization and coupling of this tetrazonium salt, are well known from azo dye chemistry. In fact, at least one of the arylazophenol intermediates — i.e., 4,4'-bis(2,4-dihydroxyphenylazo)-3,3-dimethylbiphenyl — prepared by coupling tetrazotized ortho-tolidine with resorcinol is well known in the art of dye making as pyramidol brown T; its preparation being described in U.S. Pat. No. 361,404. As a general matter, the tetrazotization of the aromatic diamine starting matter is most conveniently carried out by reaction with sodium nitrite in the presence of hydrochloric acid at temperatures below 1° C. This tetrazonium salt is then coupled with the appropriate difunctional aromatic phenol or aminophenol by direct addition of the salt to the difunctional aromatic compound or vice versa under controlled conditions of acidity or basicity. This coupling reaction is generally carried out at low temperatures (below about 15° C.) to avoid coupling two arylazo moieties to the same difunctional aromatic nucleus. In the case where the arylazo compound is coupled with a difunctional aminophenol compound, it is preferable to add the aminophenol (metaaminophenol) in stagewise fashion to the arylazo compound while controlling the basicity of the arylazo compound so that little ionization of the phenol to phenoxide occurs. Under these conditions, coupling will occur in the ortho position on the phenol to give the isomer orientation shown in the structural formula above. In general, it is desirable to carry out the first two reactions of the synthesis scheme (tetrazotization and coupling) in aqueous solution since the product of coupling is readily recoverable by filtration from the aqueous media.

The final step of the reaction sequence — i.e., reaction of the arylazophenol or arylazoarylamine intermediate with an isocyanate to obtain the desired urethane or urea — can be carried out in situ by adding the reactants to the lubricating oil base vehicle or ex situ by reaction in an organic solvent of appropriate polarity. From the standpoint of product yield and handling ease, it is preferable to carry out the reaction in the absence of the base oil vehicle (ex situ). Further advantages accrue from this preferred preparation technique, since, as pointed out previously, it has been found that grease thickners according to the invention, when prepared in the absence of the carrier oil, can be readily formulated into high quality greases via mixing of the powdered thickener with the base oil followed by shearing according to conventional techniques. The solvent employed in this preferred synthesis scheme is suitably an organic solvent of intermediate polarity such as an ester or an ether. Preferred solvents in this application are the lower alkyl esters with ethyl acetate being most preferred. In any case, this final synthesis step is suitably carried out by reacting two equivalents of the isocyanate with the phenol or amine intermediate in the presence of a basic catalyst at room temperature followed by reflux as the reaction nears completion.Suitable catalysts for this final synthesis step include triethylamine, N,N-dimethylbenzylamine, 1,4-diazobicyclooctane and heptamethylisobiquanide with 1,4-diazobicyclooctane being especially preferred when the final desired product is a urea. After completion of the reaction period the final product can be conveniently recovered, in cases where an organic solvent is used, by vacuum distillation of the solvent. When the organic thickeners of the invention are prepared in the absence of the base lubricating oil. incorporation into the base oil is readily accomplished by converting the thickener into a fine powder with conventional grinding techniques, e.g., a hammer mill, and adding the fine powder to the base oil with agitation. This slurry of thickener in base oil can then be converted to a smooth grease by sequential shearing using conventional techniques, e.g., Gaulin homogenizer, and baking at a temperature of about 300° C.

followed by a final shearing step using the same techniques.

The aromatic diamine starting which can be suitably employed in preparing the organic grease thickeners of the invention include diamino substituted aromatic compounds containing one or more aromatic rings, optionally ring substituted with aliphatic hydrocarbyl radicals. Suitable aromatic diamine reactants include mononuclear aromatic compounds such as paraphenylenediamine and 2,5-diaminotoluene and dinuclear aromatic compounds such as 1,4-diaminonaphthalene, benzidine, and ortho-tolidine. Especially preferred diamine reactions are the diphenyl derivatives, benzidine and ortho-tolidine.

The difunctional (hydroxy or hydroxy and amino) aromatic reactant employed in the preparation of the thickeners of the invention is dependent on the chemical make-up sought for the final product, i.e., whether a urea or urethane produce is desired. In cases where the final product desired is a urethane (compounds according to the general formula above wherein B is oxygen), the difunctional aromatic reactant employed in the coupling reaction is resorcinol. In contrast, when the desired final product is a urea (compounds of the above general formula where B is nitrogen), then the difunctional aromatic reactant employed is meta-aminophenol.

The isocyanates which can be employed in preparing the grease thickeners of the invention include aliphatic monoisocyanates or mixtures of aliphatic monoisocyanates wherein the aliphatic substituent contains 16 to 22 carbon atoms. Suitable monoisocyanate reactants include straight-chain or branched-chain, saturated or unsaturated, aliphatic monoisocyanates. Preferably, the monoisocyanate reactant is a straight- or branched-chain, saturated aliphatic monisocyanate having from 16 to 22 carbon atoms in the aliphatic substituent group (R group of triazine-urea structural formula above). Most preferably, the monisoocyante is a long-chain alkylisocyanate having a straight-chain alkyl group of 18 to 21 carbon atoms. Examples of such isocyanates include hexadecylisocyanate, heptadecenylisocyanate, nonadecylisocyanate, eicosylisocyanate, docosylisocyanate, 5-methylhexadecylisocyanate and hexadecenylisocyanate. Certain of the aliphatic monisocyanate reactants employed in preparation of the compounds of the invention are available from commercial sources; others can be conveniently prepared from the corresponding amines by phosgenation of the amine hydrochloride.

The thickening agents of the invention are generally employed in grease compositions in an amount sufficient to gel the lubricating oil or oleaginous base vehicle to grease consistency. This amount can vary, for example, from about 5–50% by weight of the total composition. Normally, however, with the good thickening efficiencies obtainable with the instant compounds, thickener concentrations of 10–35% by weight are sufficient to impart the desired consistency to base vehicle.

A wide variety of lubricating oils may be employed as the base vehicle in the present compositions. Suitable base oils include mineral lubricating oils such as naphthenic base, paraffin base or mixed base oils having a viscosity in the range of from 50 SSU at 100° F. to 300 SSU at 210° F.; synthetic hydrocarbon oils such as oligomerized alpha-olefins and oils derived from coal products; synthetic oils such as alkylene polymers, alkylene, oxide-type polymers; polyalkene glycols, polyethers, phosphate esters, dicarboxylic acid esters and pentaerythritol esters. The above oils may be used individually or in mixtures thereof, wherever miscible or made so by the use of solvent. Of the aforementioned base oils, mineral lubricating oils having viscosities of from about 400 to 700 SSU at 100° F. are especially preferred.

In addition to the arylazo thickeners, the present compositions can also contain anticorrosion additives such as disodium sebacate, glyceryl monoleate, sodium sulfonates, sodium nitrite, amino- and benzo-triazoles, and isostearamides of imidazolines of tetraethylenepentamine; oxidation inhibitors such as phenyl-alpha-naphthylamine, phenyl-beta-naphthylamine, diphenylamines, phenothiazine, dithiocarbamates and various analogs and homologs thereof; viscosity index improvers such as methacrylate polymers and copolymers; extreme pressure agents, and any other additive recognized in the art to perform a particular function or functions.

The following illustrative embodiments depict the method of preparation of the present thickeners and their high temperature properties. It is to be understood, however, that these embodiments are presented for illustrative purposes only and that the invention in its broader aspects should not be limited thereto.

ILLUSTRATIVE EMBODIMENT I

A 1-liter beaker equipped with mechanical stirring and surrounded with an ice-salt bath was charged with 6.4g of ortho-tolidine (0.03 moles), 200 ml of water, and 14 ml of concentrated hydrochloric acid (0.12 moles). This solution was cooled in the ice bath and brought to and maintained at 0° C. by additions of small amounts of distilled water ice. The solution was tetrazotized over a period of about 30 minutes by adding, in small portions, a solution of 4.2g of sodium nitrite (0.06 moles) in 100 ml of water. When the tetrazotization was complete (positive nitrite test), a small amount of urea was added to destroy the excess nitrite and the solution transferred to a cold flask packed in ice. The tetrazotate solution was then added in portions over about an hour to a solution of 6.6g of resorcinol (0.06 moles), 40g of sodium borate, and 10 ml of concentrated hydrochloric acid (pH 8 buffer) in 1 liter of water contained in a 3-liter beaker. The coupling reaction was carried out at 15° C. with rapid stirring and the solution was stirred for an additional hour after the last portion of tetrazonium salt had been added. The reaction mixture was then acidified and the product filtered off using sintered glass filter funnels. The funnels were then placed directly into a vacuum oven and the product dried at about 80° C. at house vacuum. The dried product was ground to a fine powder, placed in a 1-liter flask, and stirred with about 800 ml of warm water for about an hour. The product was filtered off and again dried in a vacuum oven to yield 12g of 4,4'-bis(2,4-dihydroxyphenylazo)-3,3-dimethylbiphenyl.

3.5g (0.006 moles) of the above product was charged to a 300 ml flask along with 150 ml of ethylacetate solvent and 4.7g (0.016 moles) of octadecylisocyanate (Mondur O Mobay Chemical Company). To this mixture was added 0.5g of heptamethylisobiguanide catalyst and the catalyzed reaction mixture was stirred at room temperature (20° C.) for 3 days. During this period the reaction was followed by taking aliquot samples of the reaction mixture and examining their infrared spectra for disappearance of the isocyanate band and appearance of the urethane band. At the end of the reaction period, at room temperature, the reaction mixture was heated to reflux and refluxed for 4 hours to complete the reaction. The reaction mixture was filtered and the filtrate air dried. The dried filtrate was then powdered, suspended in 200 ml benzene for 1 hour, vacuum filtered and dried, yielding 6.3g of 4,4'-bis(4-octadecylcarbamoyloxy-2-hydroxyphenylazo)-3,3'-dimethylbiphenyl.

ILLUSTRATIVE EMBODIMENT II

A solution of 6.3g of ortho-tolidine and 18 ml of concentrated hydrochloride acid in 200 ml of water was tetrazotized at 0° C. with a solution of 4.2g of sodium nitrile in 100 ml of water according to the procedure described in Illustrative Embodiment I. To this solution was added a solution of 6.6g of 3-aminophenol in 15 ml of glacial acetic acid. The mixture was stirred and slowly allowed to warm to room temperature. The pH was adjusted from about 1 to 4 using sodium acetate and the mixture stirred for another hour. The mixture was filtered and the filter cake dried overnight in the vacuum oven. The product was then ground to a fine powder and stirred in warm water for several hours. The wash solution was filtered and the product again dried in the vacuum oven to yield 12.8g of 4,4'-bis(4-amino-2-hydroxyphenylazo)-3,3'-dimethylbiphenyl.

3.6g of the above product was charged to a 300 ml flask along with 150 ml of ethylacetate solvent and 4.7g of octadecylisocyanate (Mondur O Mobay Chemical Company). To this mixture was added 0.5g of 1,4-diazobicyclooctane catalyst and the catalyzed reaction mixture was stirred at room temperature (20° C.) for 3 days. The reaction mixture was then filtered and the filtrate dried under vacuum yielding 4.6g of 4,4'-bis(4-ocatadecylureylene-2-hydroxy-phenylazo)-3,3'-dimethylbiphenyl.

ILLUSTRATIVE EMBODIMENT III

Thickened grease compositions according to the invention were prepared from the urethane and urea produces of Illustrative Embodiments 1 and II using an HVI 70/210 Neutral Oil carrier. To prepare these grease compositions, the urethane or urea thickener was ground to a fine powder with a mortar and pestle and the powdered thickener was added slowly to the base oil with stirring to afford a fine dispersion of thickener in base oil. This dispersion was heated at 100° C. for ½ hour and milled twice on a 3 roll paint mill. It was then placed in an oven at 300° F. for 4 hours and remilled to yield the final grease formulation.

The grease prepared according to the procedure from the thickener of Illustrative Embodiment I (12% thickener in base oil) exhibited an ASTM dropping point of 500° F. and a modified ASTM unworked penetration (¼ scale) of 65. Similarly, the grease prepared from the thickener of Illustrative Embodiment II (15% thickener concentration) showed an ASTM dropping point of 345° F. and a modified ASTM unworked penetration (¼ scale) of 65.

ILLUSTRATIVE EMBODIMENT IV

In order to demonstrate the excellent high temperature performance characteristics of the present grease compositions, the thickening Illustrative Embodiment I, fully formulated with commercial additives and 70/210 Neutral Oil in several formulations, was subject to a variety of conventional bearing tests. The results of these tests are shown in the following table:

| Formulation | Bearing Test | Bearing Life (hrs.) |
|---|---|---|
| Formulation A[a)] | 350° F Pope Rig Test[d)] | 248 |
| | | 315 |
| | | 347 |
| | | 354 |
| Formulation B[b)] | 350° F Pope Rig Test[d)] | 412 |
| | | 466 |
| Formulation A | 311° F Modified Navy Rig Test[e)] | 855 |
| | | 1310 |
| | | 1468 |
| | | 1952 |
| Formulation C[c)] | 311° F Modified Navy Rig Test[e)] | 468 |
| | | 686 |

[a)]Formulation A contains 1% w LO-6 and 1% w sodium sebacate.
[b)]Formulation B contains 1% w LO-6, and 0.5% w LO-4 and 1% sodium sebacate.
[c)]Formulation C contains 1% w LO-6, 0.5% w oronite 250 and 1% w sodium sebacate.
[d)]Federal Test Method Standard 791a Method 333-204S-17 Bearing 10m rpm, 15 lb radial load, cyclic operation.
[e)]Federal Test Method, 331.1 - 204h Bearing, 10m rpm, 10 lb axial load, 3 lb radial load, continuous running.

What is claimed is:

1. An azoaryl compound defined by the formula:

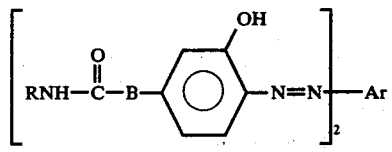

wherein R is an aliphatic hydrocarbyl radical of 16 to 22 carbon atoms, B is —NH— or oxygen, and Ar is an arylene radical selected from the class consisting of phenylene, naphthylene and diphenylene, said arylene radical being either unsubstituted or substituted on each aromatic ring with an aliphatic hydrocarbyl radical of 1 to 4 carbon atoms.

2. The compound according to claim 1, wherein R is a straight-chain alkyl of 18 to 21 carbon atoms.

3. The compound according to claim 2 wherein AR is a diphenylene radical, said diphenylene radical being either unsubstituted or substituted on each aromatic ring with a straight-chain alkyl radical of 1 to 2 carbon atoms.

4. An azourethane compound of the formula:

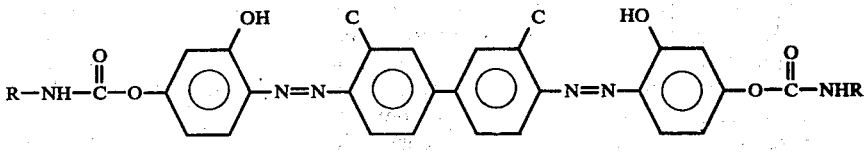

wherein R is an aliphatic hydrocarbyl of 16 to 22 carbon atoms and C is hydrogen or straight-chain alkyl of 1 to 4 carbon atoms.

5. The compound according to claim 4 wherein R is a straight-chain alkyl of 18 to 21 carbon atoms and C is methyl.

6. 4,4'-bis(4-octadecylcarbamoyloxy-2-hydroxyphenylazo)-3,3'-dimethylbiphenyl.

7. 4,4'-bis(4-octadecylureylene-2-hydroxyphenylazo)-3,3'-dimethylbiphenyl.

* * * * *